United States Patent [19]

Chinski et al.

[11] Patent Number: 4,809,892

[45] Date of Patent: Mar. 7, 1989

[54] STUDIO PACK

[76] Inventors: Michael D. Chinski; Carol A. Chinski, both of 1558 W. Shawnee, No. 140, both of Baroda, Mich. 49101

[21] Appl. No.: 175,169

[22] Filed: Mar. 30, 1988

[51] Int. Cl.[4] ..... A45F 4/02

[52] U.S. Cl. ..... 224/155; 108/33; 206/1.7; 206/575; 224/153; 248/461; 294/143; 294/146; 297/17

[58] Field of Search ..... 224/151, 153, 155, 156; 206/1.7, 575; 248/460, 461, 230; 297/17; 294/141, 142, 143, 146; 108/33, 34, 38, 43

[56] References Cited

U.S. PATENT DOCUMENTS

| | | | |
|---|---|---|---|
| 154,583 | 9/1874 | Chormann | 206 X/1.7 X |
| 779,202 | 1/1905 | Burgess | 206/1.7 X |
| 2,372,077 | 3/1945 | Glinecki | 206/1.7 X |
| 2,751,271 | 6/1956 | Dessertenne et al. | 206/1.7 X |
| 2,836,334 | 5/1958 | Davis | 224/153 |
| 3,165,367 | 1/1965 | Rose | 312/231 |
| 3,202,471 | 8/1965 | Wilson | 248/461 X |
| 3,476,456 | 11/1969 | Canavan | 312/231 |
| 3,912,138 | 10/1975 | Pava | 224/154 |
| 4,057,215 | 11/1977 | Stettler | 248/460 |
| 4,076,348 | 2/1978 | Allison | 248/461 X |
| 4,234,005 | 11/1980 | Taylor, III | 224/154 X |
| 4,372,630 | 2/1983 | Fahri | 206/1.7 X |
| 4,449,655 | 5/1984 | Germe | 224/153 |
| 4,574,990 | 3/1986 | Remis | 224/155 X |

FOREIGN PATENT DOCUMENTS

| | | | |
|---|---|---|---|
| 136581 | 7/1952 | Sweden | 248/460 |

*Primary Examiner*—Philip R. Coe

*Attorney, Agent, or Firm*—Jeffers, Hoffman & Niewyk

[57] ABSTRACT

An artist's kit including an easel, a bench, and a storage compartment unit. The easel includes three legs which may be disassembled into leg segments. The seat includes detachable legs and a storage compartment. The easel leg segments and the detachable bench legs may be stored in the storage compartment of the seat. The storage compartment unit includes a plurality of pockets for storing various artist's painting and drawing supplies. The storage compartment also includes a cover and a plurality of straps for securing the storage compartment and cover to the seat bushings when the seat is disassembled. The storage compartment unit further includes a plurality of straps whereby the seat, easel, and storage compartment unit may be carried as a unitary back pack. A canvas carrying apparatus is provided for transporting a framed canvas on the back pack.

18 Claims, 3 Drawing Sheets

STUDIO PACK

BACKGROUND OF THE INVENTION

This invention relates to an artist's kit including an easel, canvas, paints, brushes and the like and particularly to an artist's kit which may be transported as a back pack.

Many artists paint in the out of doors and therefore must transport their canvas, easel and other supplies to field locations. Since painting may involve a considerable amount of equipment, it is desirable to provide a compact portable artist's kit wherein all of the artist's supplies may be stored and which may be easily transported to field locations.

Conventional artist's kits typically include some type of a collapsible easel, a collapsible seat and some type of box or container in which all of the equipment may be packed. The container normally includes numerous pockets and trays for holding paint tubes, a sketch pad, canvas, brushes, turpentine and the like. Such a container must be carried by hand as a suitcase.

A disadvantage of such prior art artist's kits is that they are cumbersome to carry since they must be carried by hand. Such prior art artist's kits have also been rather complicated and costly. Furthermore, some of these prior art artist's kits have not included a seat, which detracts considerably from their usefulness. Additionally, most prior art artist's kits have limited the canvas size which could be carried. Prior art artist's kits make no provision for carrying a completed canvas (which cannot be rolled up) and therefore had to be carried by hand. Finally, prior art artist's kits have also limited the amount of supplies which could be carried by the artist, thereby unduly limiting the artist's performance.

It is therefore desired to provide an artist's kit or studio pack or back pack whereby an artist may carry all of the supplies needed to a field location. It is furthermore desired to provide such an artist's kit whereby a full size easel may be carried in the back pack as well as a full size canvas and frame therefor. It is still furthermore desired to provide such an artist's kit including a seat which doubles as a storage container for the easel. Lastly, it is desired to provide an artist's kit which includes novel clamps to clamp a canvas to the easel.

SUMMARY OF THE INVENTION

The present invention, in one form thereof, overcomes the disadvantages of the above described prior art artist's kits by providing an improved artist's kit therefor.

The present invention, in one form thereof, comprises an artist's kit in the form of a back pack whereby all of the artist's supplies may be carried in a unitary back pack and transported to a field location.

The artist's kit according to the present invention, in one form thereof, forms a unitary back pack whereby the artist may go out into the field with virtually the same comfort and number of supplies as would be available to him in the studio. The artist's kit comprises a back pack including a collapsible easel, a collapsible bench or seat and a storage unit which contains pockets, trays, retainers for paint tubes, sketch pad, brushes, turpentine and various other hardware and painting supplies. The bench converts into a carrying case for the easel and is attached to the storage unit to form a unitary back pack. The back pack may be strapped to a person's back in similar fashion to conventional back packs. A completed painting may be affixed to the back pack and carried in that fashion.

An advantage of the present invention is that by providing a back pack artist's kit, the artist's hands are freed up thereby making it considerably easier for the artist to transport his supplies to a field location.

Another advantage of the present invention is that the artist may easily transport a full size easel and a full size frame and canvas.

A still further advantage of the present invention is that the bench or seat is separate from the easel so that the artist may position the bench as desired for greater comfort in painting.

A yet further advantage of the present invention is that the artist may transport a completed canvas without the need to carry the painted canvas in his hands.

Yet another advantage of the artist's kit according to the present invention is that it is easy to disassemble and clean.

The present invention, in one form thereof, comprises an artist's kit including an easel which has a plurality of segmented legs which may be disassembled into a plurality of leg segments. The kit further includes a bench which has a seat, the seat having a first storage compartment for storing the leg segments therein. The bench further includes a plurality of bushings which are secured to the seat and a plurality of bench legs which may be detachably secured to the seat by being respectively inserted into the respective bushings. A storage compartment unit is provided including a plurality of first straps for securing the storage compartment unit to the bushings. The storage compartment unit further includes a plurality of carrying straps. A cover is provided for the storage compartment unit including a second carrying strap whereby the easel, bench, storage compartment unit, and cover may be transported as a unitary back pack. The canvas carrying means is detachably secured to one of the bushings for transporting a framed canvas on the back pack.

The present invention, in one form thereof, comprises an easel which includes a plurality of segmented legs which may be disassembled into a plurality of leg segments. The kit further includes a bench having a seat which includes a first storage compartment for storing the leg segments therein. The bench further includes a plurality of bushings secured to the seat and a plurality of bench legs which may be detachably secured to the seat by being respectively inserted into the respective bushings. A storage compartment unit includes a plurality of first straps for securing the storage compartment unit to the respective seat bushings. The storage compartment unit further includes carrying straps whereby the kit may be transported as a back pack. A canvas carrying device is detachably secured to one of the bushings for transporting a framed canvas on the back pack.

The present invention, in one form thereof, comprises an artist's kit including an easel which has a plurality of legs and wherein each of the legs has a plurality of detachable leg members. The kit further includes a bench having a seat wherein the seat includes a first storage compartment for storing the leg members therein. A plurality of securement members are attached to the seat and a plurality of legs are detachably secured to the respective securement members. A storage compartment member is provided including a first strap for securing the storage compartment member to both the securement members and the seat. Carrying straps are provided on the storage compartment member for carrying the kit as a unitary back pack.

It is an object of the present invention to provide an artist's kit which may be transported as a back pack and which includes all of the supplies and equipment needed by an artist for painting in the field.

It is another object of the present invention to provide an artist's kit whereby the artist may carry a full size easel bench, a full size frame and canvas as a back pack.

Still another object of the present invention is to provide an artist's kit whereby the artist may transport a completed framed canvas on the back pack.

Still a further object of the present invention is to provide an artist's kit which may be easily disassembled and which is easy to clean.

Yet a further object of the present invention is to provide an artist's kit including a separate seat and wherein the canvas angle for painting may be adjusted without adjusting the easel.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

Corresponding reference numbers indicate corresponding parts throughout the several views of the drawings. The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
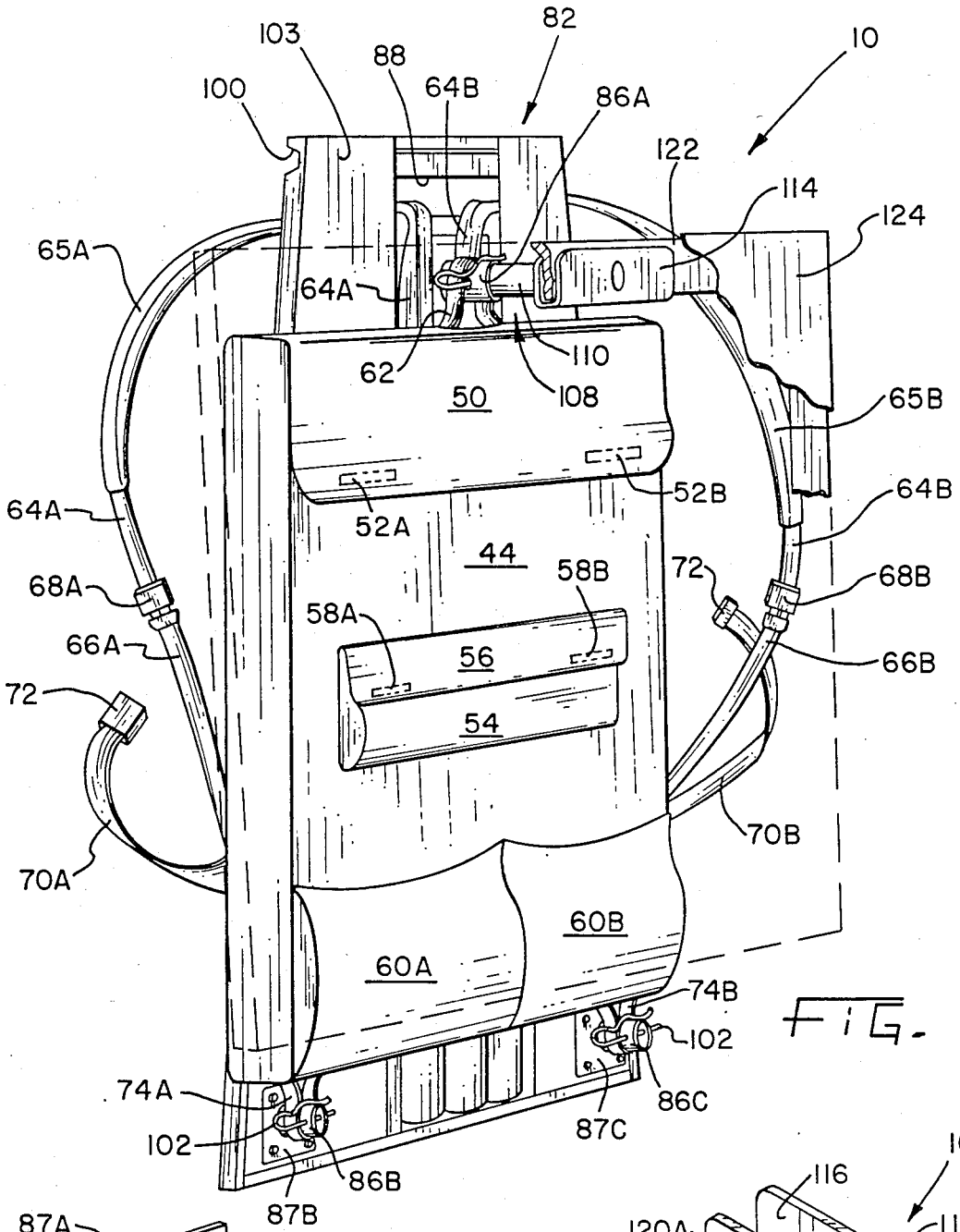
FIG. 1 is a perspective view of the artist's kit assembled as a back pack.
Figure 2:
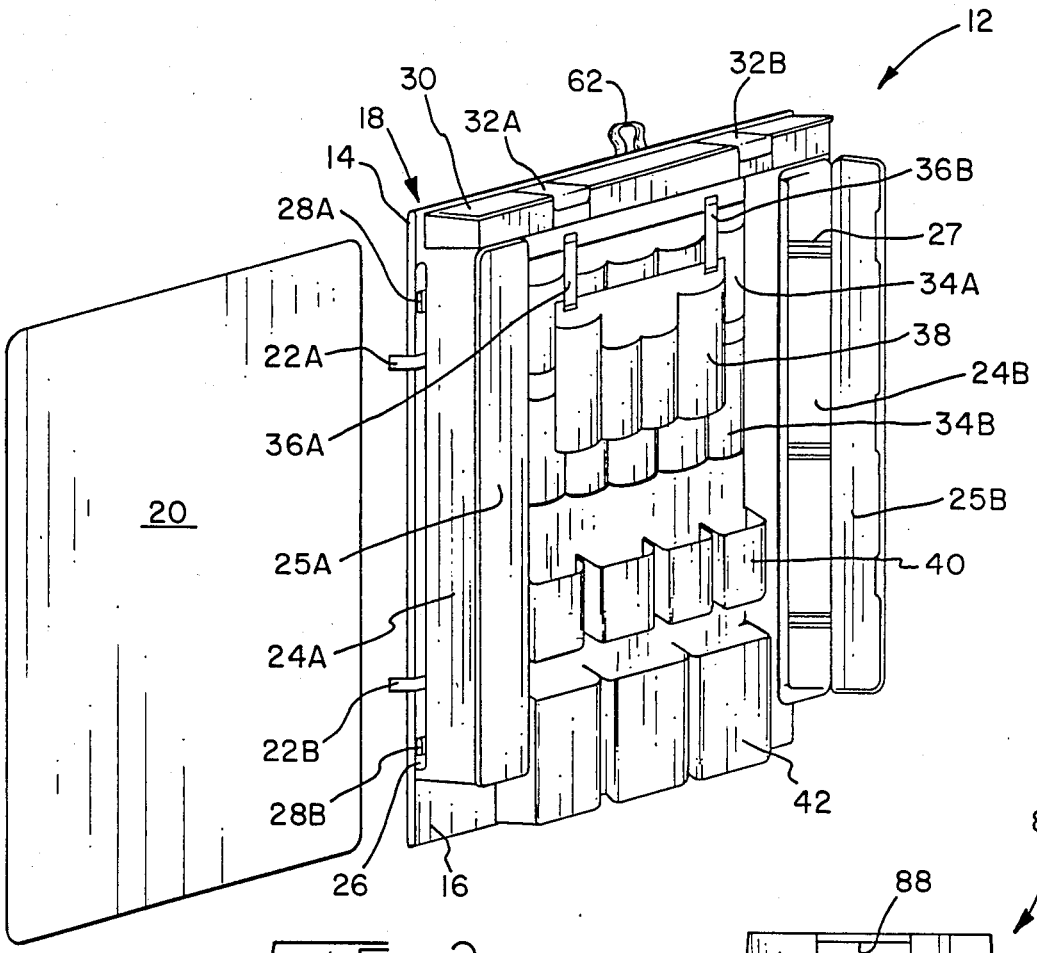
FIG. 2 is a perspective view of the storage compartment unit for the back pack of FIG. 1.
Figure 9:
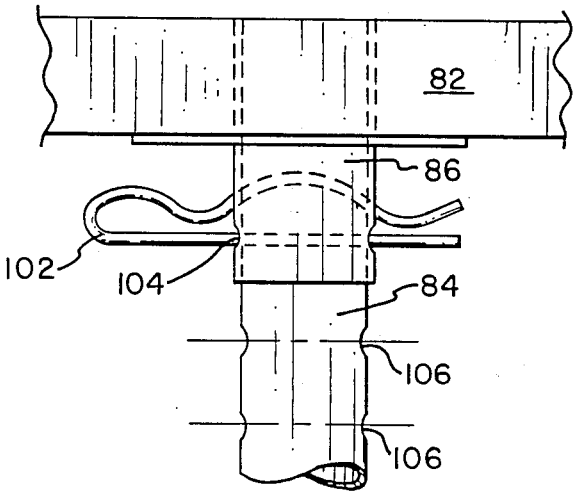
FIG. 9 is an enlarged, elevational, broken away view of a seat bushing and seat leg assembly.

Referring first to FIGS. 1 and 2, the artist's kit according to the present invention is shown assembled as a back pack 10 including a main storage compartment unit 12 for storing paint tubes, varnishes, brushes and other painting and sketching supplies. Storage compartment unit 12 is formed from a flat fabric rear member 14 and a flat fabric face member 16 which are sewn together on three sides to form an envelope 18 into which a panel 20 is inserted to give rigidity to the entire main storage compartment unit. Panel 20 is held in place by means of two fastening straps **22*a* and 22*b*** which may be provided with velcro material fastening patches or other suitable fasteners.

Two brush and supply trays **24*a* and 24*b* are secured to face member 16 by means of fabric loops 26 which are sewn to face member 16 and which retain bottom tabs 28*a* and 28*b* of the brush and supply trays 24*a* and 24*b*. Trays 24*a* and 24*b* also each include a cover respectively indicated at 25*a* and 25*b*. The storage tray 24*b* is shown with the cover 25*b* open to show ribs 27** which divide the storage tray into smaller compartments.

An excess paint tray 30 is located at the top of the main storage compartment unit 12 for storing pre-mixed paint. Tray 30 is held in place by means of two straps **32*a* and 32*b* which are sewn to face member 16. Two fabric pouches 34*a* and 34*b* for holding paint tubes are secured to face member 16. Each pouch 34, in the disclosed embodiment, can hold five paint tubes. Since pouches 34 are flexible, they may expand to allow for more paint tubes. A further tube pouch 38 is suspended from the top of face member 16 by means of two straps 36*a* and 36*b*. Pouch 38 thus is suspended over pouches 34*a* and 34*b*. At the lower portion of face member 16, two sets of pouches 40 and 42** are provided for storing various bottles for holding varnish, turpentine, oil media and the like.

The entire main storage compartment unit 12 is provided with a fabric outer cover 44 as best seen in FIG. 1. Cover 44 includes a front, back, two sides and a bottom. Thus the outer cover 44 forms a pocket into which the entire main storage compartment unit 12 may be inserted. A sketch pad and palette may be inserted behind the storage compartment 12 when it is inserted into the cover 44. A flap 50 is secured to the top of the back of cover 44 for covering the top opening of cover 44. Velcro material patches **52*a* and 52*b* or other suitable fasteners secure flap 50 in place. Cover 44 also includes a hardware storage compartment 54 including a cover 56 which is held in place by velcro material patches 58*a* and 58*b* or other suitable fasteners. Pocket 54 may be used for storing various hardware components such as canvas retainers, pins and other loose hardware for assembling the easel. Two further fabric pouches 60*a* and 60*b*** are provided for the storage of rags or other items.

The entire main storage compartment unit 12 and cover 44 may be constructed of any suitable material such as for instance canvas, nylon or the like.

Main storage compartment unit 12 includes a loop or strap 62. Two shoulder straps **64*a* and 64*b* are attached to the top central portion of cover 44. Flap 50 of cover 44 includes a slot whereby loop 62 may be inserted through the slot as best shown in FIG. 1. Shoulder straps 64*a* and 64*b* further include padding 65*a* and 65*b*. Straps 64*a* and 64*b* are secured to another pair of straps 66*a* and 66*b* which are secured to the lower part of cover 44. Straps 64 and 66 are secured together by means of clasps 68 whereby the length of shoulder straps 64 may be adjusted and separated. Waist straps 70*a* and 70*b* are provided on either side of cover 44 whereby the back pack may be strapped around a person's waist and held in palce by means of a buckle 72. The bottom of outer cover 44 is provided with two further loops or straps 74*a* and 74*b***.

Referring now to FIGS. 1, 6, 7 and 8, a bench 80 is provided including a seat 82 and legs **84*a*, 84*b* and 84*c*. When the bench is assembled for use as a seat, legs 84** are detachably inserted in bushings 86*a*, 86*b* and 86*c* which are secured to seat 82 by means of plates 87*a*, 87*b* and 87*c* which include apertures 89 therein. Thus bushings 86 and plates 87 may be secured to seat 82 by suitable fasteners such as screws or the like. A slot 88 is provided in the front portion of seat 82 whereby, as best seen in FIG. 1 when seat 82 is assembled into a back pack, shoulder straps 64 can extend upwardly from main storage compartment unit 12, through the slot (unnumbered) in the upper portion of outer cover 44 and then through slot 88 in seat 82. As further best seen from FIG. 1, loop 62 of storage compartment 12 is inserted through the slot in outer cover 44 and is then slipped over bushing 86*a*. Additionally, loops 74*a* and 74*b* are respectively slipped over bushings 86*b* and 86*c*. The loops are held in place by means of hairpin clips 102 which are inserted through apertures 104 in bushings 86. Thus the entire seat 82 may be securely attached to main storage compartment unit 12 and cover 44 to thereby form a unitary back pack.

Figure 4:
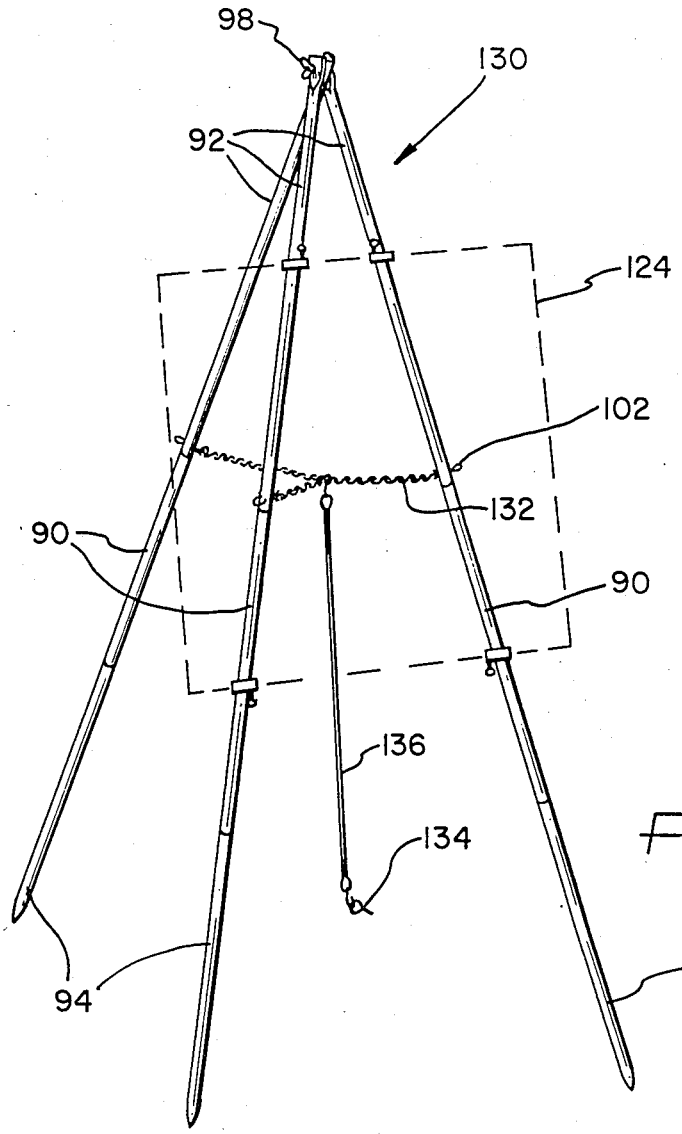
FIG. 4 is a perspective view of the assembled easel and a schematic canvas supported thereon.
Figure 5:
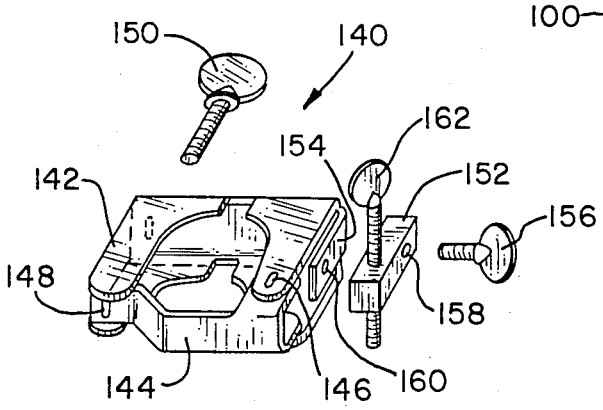
FIG. 5 is an exploded perspective view of the canvas retainer for the artist's kit of FIG. 1.
Figure 6:
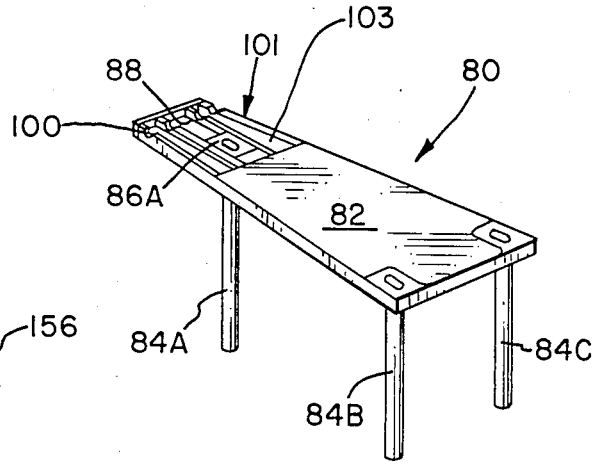
FIG. 6 is a perspective view of the asembled seat for the artist's kit of FIG. 1.
Figure 8:
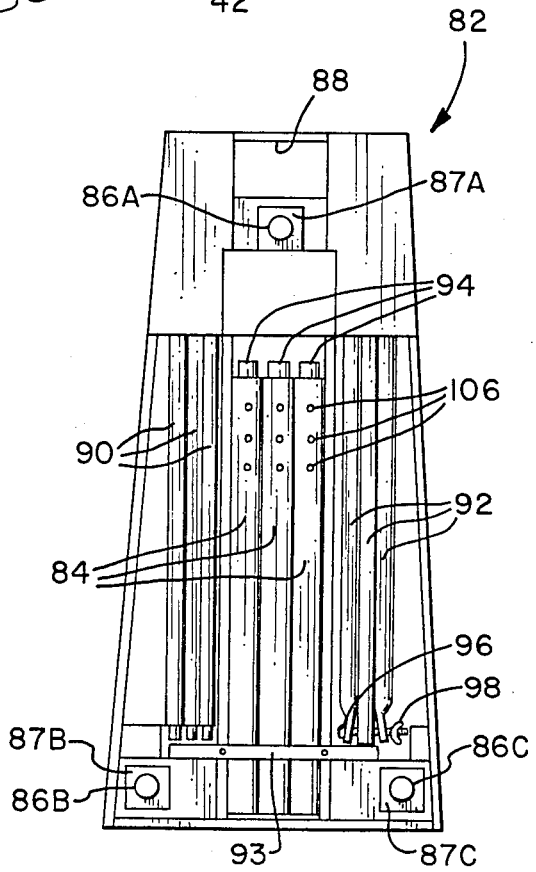
FIG. 8 is an elevational view of the bottom of the seat into which the easel and seat legs have been assembled for transport.

Referring to FIGS. 4 and 8, seat 82 serves as a storage compartment for storing the easel legs and bench legs 84. The legs of easel 130 are segmented and contain middle members 90, upper members 92, and the lower members 94. Easel upper members 92 are secured together by means of a bolt 96 and a thumb screw 98. When the kit is to be transported as a back pack, easel lower members 94 are inserted in hollow legs 84 of bench 80. The easel members are held in place by a cross member 93 which forms a part of seat 82. Thus the entire bench 80 and easel 130 form a compact unit which may be securely strapped in position when the entire assembly forms a back pack 10. Slot 88 in seat 82 forms a handle for lifting the entire back pack. Seat 82 is also provided with a notch 100, whereby when the bench 80 is assembled, as shown in FIG. 6, brushes may be retained therein. When the easel parts are removed from the seat and the seat is used as a stool, a tray 101 is provided for holding materials backed up by panel 103. The height of bench 80 is also adjustable by virtue of the provision of three apertures 106 in each of legs 84, whereby hairpin clips 102 can be selectively inserted in various apertures 106 of legs 84. It can also be seen that bushings 86 serve multiple purposes. They are used for attaching legs 84 to seat 82 when the seat is used as a stool. Furthermore, they are used to attach seat 82 to the main storage compartment unit 12 when then kit is formed into a back pack.

Figure 7:
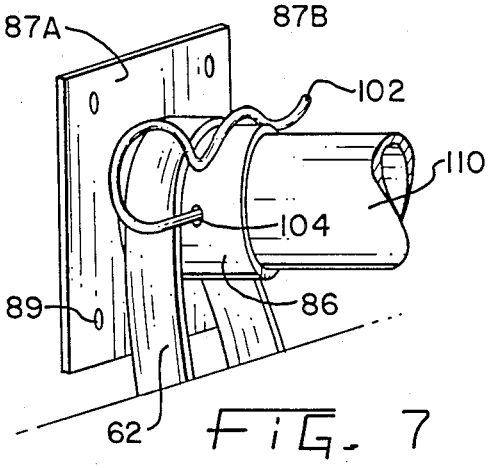
FIG. 7 is an enlarged, broken away perspective view of a seat bushing assembled for transport.
Figure 3:
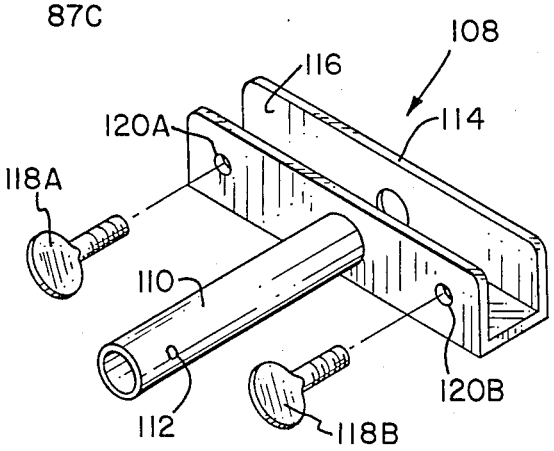
FIG. 3 is an exploded perspective view of the canvas carrying apparatus.

As best seen by referring to FIGS. 1, 3 and 7, a canvas carrying apparatus 108 is secured to the back pack 10. The canvas carrying apparatus 108 includes a shaft 110 including an aperture 112 therein whereby the shaft 110 may be inserted in bushing 86 and retained therein by means of the hairpin clip 102 which is inserted through aperture 104 and aperture 112 in shaft 110. At its other end, shaft 110 is secured by any suitable means to a channel member 114 having a channel 116 therein. Channel 116 is provided with two threaded openings 120*a* and 120*b* into which thumb screws 118*a* and 118*b* are respectively inserted. Frame 122 of a canvas 124 is inserted into channel 114 and is retained therein by thumb screws 118. Thus a complete framed canvas, as shown in FIG. 1, may be carried on back pack 10. Thus, after the artist has completed a canvas, it may be attached directly to the back pack to be transported therewith rather than being carried by hand.

Referring now to FIG. 4, the easel assembly is shown. The upper, middle and lower leg members 92, 90 and 94 are telescopically secured to each other and retained together by means of hairpin clips 102. The bottom leg members 94 may be wood dowels which are turned down at one end to slide into middle leg members 90 and which are pointed at the opposite ends to provide a firm grip on the terrain on which the easel is placed. Thumb screw 98 and bolt 96 hold the top of the easel assembly together. The easel legs are secured to each other by means of a chain 132 and the entire easel 130 is secured to the ground by means of a tent stake 134 and an elastic member 136 which is secured to the center of chain assembly 132.

A canvas is secured to easel 130 by means of four canvas retainers 140. Each retainer 140 includes a U-shaped bracket 142 and a strap 144 pivotably secured to U-shaped bracket 142 by means of a pivot pin 146. A thumb screw 150 secures strap 144 at its other end whereby the canvas retainer 140 may be clamped around a leg of the easel by tightening thumb screw 150. A pivotable block 152 is pivotably secured to tab 154 by means of a thumb screw 156 which is disposed in an aperture 158 of block 152 and is threaded into aperture 160 of tab 154. Thumb screw 162 is provided to press against the top or the bottom of a canvas frame depending upon the location of the canvas retainer 140 on the legs of easel 130. Four canvas retainers are provided to hold the frame at four locations. Thus, by providing a pivotable block 152 on retainer 140, block 152 can be aligned with the direction of the canvas frame and the canvas can be aligned without moving the easel.

What has therefore been provided is an artist's kit which can be easily transported as a back pack and which includes all of the supplies and implements which an artist may need at a field location.

While this invention has been described as having a preferred design, it will be understood that it is capable of further modification. This application is therefore intended to cover any variations, uses, or adaptation of the invention following the general principles thereof and including such departures from the present disclosure as come within known or customary practice in the art to which this invention pertains and fall within the limits of the appended claims.

What is claimed is:

1. An artist's kit comprising:

an easel, said easel including a plurality of segmented legs which may be disassembled into a plurality of leg segments;

a bench including a seat, said seat including a first storage compartment for storing said leg segments therein, said bench further including a plurality of bushings secured to said seat and a plurality of bench legs which may be detachably secured to said seat by being respectively inserted into said respective bushings;

a storage compartment unit including a plurality of first straps for securing said storage compartment unit to said bushings, and further including first carrying strap means;

a cover for said storage compartment unit including second carrying strap means whereby said easel, bench, storage compartment unit, and cover may be transported as a unitary back pack; and canvas carrying means detachably secured to one of said bushings for transporting a framed canvas on said back pack.

2. The kit according to claim 1 wherein said easel includes a plurality of canvas mounting members, each said canvas mounting members including means for securing said canvas mounting member to a leg of said easel and clamping means for clamping a canvas frame to thereby secure said frame to said easel.

3. The kit according to claim 2 wherein said clamping means of each said canvas mounting members comprises a pivotable member pivotably secured to said canvas mounting member securing means and a clamp adjustably mounted on said pivotable member for contacting and clamping a said canvas frame.

4. The kit according to claim 1 wherein said canvas carrying means comprises a shaft and a channel member secured to said shaft, said shaft adapted to be inserted into one of said bushings, and said channel member adapted to receive a canvas frame.

5. An artist's kit comprising:

an easel, said easel including a plurality of segmented legs which may be disassembled into a plurality of leg segments;

a bench including a seat, said seat including a first storage compartment for storing said leg segments therein, said bench further including a plurality of bushings secured to said seat and a plurality of bench legs which may be detachably secured to said seat by being respectively inserted into said respective bushings;

a storage compartment unit including a plurality of first straps for securing said storage compartment unit to said respective seat bushings, and carrying strap means whereby said kit may be transported as a back pack; and a canvas carrying means detachably secured to one of said bushings for transporting a framed canvas on said back pack.

6. The kit according to claim 5 wherein said storage compartment comprises a storage member having a plurality of storage pockets therein and a cover member for covering said storage member.

7. The kit according to claim 5 wherein said easel includes a plurality of canvas mounting members, each said canvas mounting member including means for securing said canvas mounting member to a leg of said easel and clamping means for clamping a canvas frame and thereby securing said frame to said easel.

8. The kit according to claim 7 wherein said clamping means of each said canvas mounting member comprises a pivotable member pivotably secured to said securing means and a clamp adjustably mounted on said pivotable member for contacting and clamping a canvas frame.

9. The kit according to claim 5 wherein said canvas carrying means comprises a shaft and a channel member secured to said shaft, said shaft adapted to be inserted into one of said bushings, and said channel member adapted to receive the frame of a canvas.

10. The kit according to claim 5 wherein said easel comprises a tripod.

11. An artist's kit comprising:

an easel, said easel including a plurality of legs, said legs each having a plurality of detachable leg members;

a bench including a seat, said seat having a first storage compartment for storing said leg members therein, a plurality of securement members attached to said seat and a plurality of legs which may be detachably secured to said respective securement members;

a storage compartment member including first strap means for securing said storage compartment member to both said securement members and said seat, and carrying strap means for carrying said kit as a unitary back pack.

12. The kit according to claim 11 wherein said storage compartment comprises a storage member having a plurality of storage pockets therein and a cover member for covering said storage member.

13. The kit according to claim 11 wherein said easel includes a plurality of canvas mounting members, each said canvas mounting members including means for securing said canvas mounting member to a leg of said easel and clamping means for clamping a canvas frame to thereby secure said frame to said easel.

14. The kit according to claim 13 wherein said clamping means of each said canvas mounting members comprises a pivotable member pivotably secured to said securing means and a clamp adjustably mounted in said pivotable member for contacting the frame of a canvas.

15. The kit according to claim 11 including means for securing a canvas frame to one of said securement members when said seat is secured to said storage compartment member, whereby an assembled canvas may be carried on said back pack.

16. The kit according to claim 15 wherein said canvas carrying means comprises a shaft and a channel member secured to said shaft, said securement members comprising tubular bushings whereby said shaft may be inserted into one of said bushings and the canvas frame may be inserted into said channel member.

17. The kit according to claim 11 wherein said securement members comprise tubular bushings.

18. The kit according to claim 11 wherein said easel comprises a tripod.

* * * * *